US011426747B2

(12) United States Patent
Jia et al.

(10) Patent No.: US 11,426,747 B2
(45) Date of Patent: Aug. 30, 2022

(54) HAND-HELD BATTERY OPERATED SPRAYER WITH ROTATABLE SPRAY LANCE

(71) Applicant: Hangzhou Weirran Machinery Co., Ltd, Hangzhou (CN)

(72) Inventors: Qunwei Jia, Hangzhou (CN); Qili Lu, Hangzhou (CN)

(73) Assignee: HANGZHOU WEIRRAN MACHINERY CO., LTD, Hangzhou (CN)

( * ) Notice: Subject to any disclaimer, the term of this patent is extended or adjusted under 35 U.S.C. 154(b) by 381 days.

(21) Appl. No.: 16/692,533

(22) Filed: Nov. 22, 2019

(65) Prior Publication Data

US 2021/0129164 A1 May 6, 2021

(30) Foreign Application Priority Data

Oct. 31, 2019 (CN) ..... 201911050226.1

(51) Int. Cl.

| | |
|---|---|
| ***B05B 9/08*** | (2006.01) |
| ***B05B 11/00*** | (2006.01) |
| ***B05B 15/68*** | (2018.01) |
| ***B05B 12/00*** | (2018.01) |

(52) U.S. Cl.

CPC ..... *B05B 9/0861* (2013.01); *B05B 11/3057* (2013.01); *B05B 15/68* (2018.02); *B05B 12/0026* (2018.08)

(58) Field of Classification Search

CPC ..... B05B 9/0403; B05B 9/0426; B05B 9/08; B05B 9/085; B05B 9/0855; B05B 9/0861; B05B 11/3042; B05B 11/3057; B05B 12/002; B05B 12/0022; B05B 12/0024; B05B 12/0026; B05B 15/14; B05B 15/65; B05B 15/652; B05B 15/68

See application file for complete search history.

(56) References Cited

U.S. PATENT DOCUMENTS

| | | | | |
|---|---|---|---|---|
| 2012/0223160 | A1* | 9/2012 | Goodwin | B05B 15/652 239/525 |
| 2013/0193232 | A1* | 8/2013 | Dobias | B05B 7/2443 239/308 |
| 2015/0129682 | A1* | 5/2015 | Mitchell | A01M 7/0046 239/269 |
| 2016/0296956 | A1* | 10/2016 | Bailey | B05B 9/01 |
| 2019/0336998 | A1* | 11/2019 | Falcon | B65D 47/04 |

* cited by examiner

*Primary Examiner* — Darren W Gorman

(74) *Attorney, Agent, or Firm* — Muncy, Geissler, Olds & Lowe, P.C.

(57) ABSTRACT

A hand-held battery operated sprayer with a rotatable spray lance includes a spray lance assembly and a spray chamber. A motor, a pump, a shutoff valve, a suction hose assembly, a pump inlet hose, a pump outlet hose, a battery pack, and a conductor are disposed in the spray chamber. Water sequentially passes the suction hose assembly, the shutoff valve, the pump inlet hose, the pump, and the pump outlet hose, and flows out of the spray chamber. A rotary axle base is disposed at the front end of the spray chamber. A right-angled rotating shaft is movably connected in the rotary axle base. The rotating shaft is connected to the spray lance assembly. The pump outlet hose can reach a nozzle of the spray lance assembly through the rotating shaft.

6 Claims, 3 Drawing Sheets

HAND-HELD BATTERY OPERATED SPRAYER WITH ROTATABLE SPRAY LANCE

TECHNICAL FIELD

The present invention relates to the field of sprayer technologies, and in particular, to a hand-held battery operated sprayer with a rotatable spray lance.

BACKGROUND

When a user uses a hand-held sprayer, a relatively long spray lance is usually required, so that a nozzle is as far as possible away from a human body and is as close as possible to a target object and a spraying area. This can avoid a latent harm to a person during work. However, the relatively long spray lance makes a product size excessively large, and packaging, storage, and transportation are very inconvenient.

Usually, a threaded connection manner or another detachable connection manner is used between the spray lance and the sprayer. During assembling and disassembling, a residual liquid at a joint between the spray lance and the sprayer easily leaks, and a user feels inconvenient. Therefore, a connection manner without a need of disassembling and convenient for storage between a long spray lance and a sprayer is a technical challenge to be addressed in the present invention.

SUMMARY

The present invention aims to provide hand-held battery operated sprayer with a rotatable spray lance that does not need to be disassembled and that is convenient for storage.

To achieve the foregoing objective, the present invention adopts the following technical solution:

A hand-held battery operated sprayer with a rotatable spray lance is provided, including a spray lance assembly and a spray chamber, where a motor, a pump, a shutoff valve, a suction hose assembly, a pump inlet hose, a pump outlet hose, a battery pack, and a conductor are disposed in the spray chamber, water sequentially passes the suction hose assembly, the shutoff valve, the pump inlet hose, the pump, and the pump outlet hose, and flows out of the spray chamber, a rotary axle base is disposed at the front end of the spray chamber, a right-angled rotating shaft is movably connected in the rotary axle base, the rotating shaft is connected to the spray lance assembly, and the pump outlet hose can reach a nozzle of the spray lance assembly through the rotating shaft.

Further, a limiting block is disposed at an inner corner of the rotating shaft, two positioning blocks are disposed in the rotary axle base in parallel, the rotating shaft rotates in the rotary axle base within a range of 180° under a limiting action of the limiting block and the positioning blocks, and a ring locking block is disposed outside the limiting block.

Further, a casing of the spray chamber is composed of two protective covers, a push switch is disposed at a junction line of the two protective covers, the push switch is connected to the shutoff valve in the spray chamber, pressing drives the shutoff valve to turn on, and the pressing between the push switch and the shutoff valve is locked through a switch lock.

Further, when a pressing operation is performed on the push switch, a motor triggering conductor and a battery contact conductor are triggered, and a battery-motor connection conductor is further disposed between the motor and the battery pack.

Further, the suction hose assembly includes a suction hose and an external suction apparatus, the external suction apparatus includes a bottle cap and a suction pipe that are of an integrated structure, and a plug at an end of the suction hose is inserted in an opening on the bottle cap and is connected to the suction pipe.

Further, a battery cover is further disposed on the casing of the spray chamber, and is used for manually installing or removing the battery pack.

Compared with the prior art, the present invention has the following advantages:

According to the hand-held battery operated sprayer with a rotatable spray lance in the present invention, a structural design is appropriate, spraying is accurate, positioning is stable and reliable, and storage is convenient. In the present invention, the spray lance can rotate at 180°, thereby adapting to a fact that a total length of the sprayer is twice that of a body of the spray chamber when the spray lance assembly is in an operating state, and the sprayer has a shorter and more compact product size when the spray lance assembly is in a storage state. In addition, the pump outlet hose is connected to the spray lance assembly and the nozzle through the rotating shaft, thereby avoiding deformation, stretching, and abrasion of the pump outlet hose.

DESCRIPTION OF EMBODIMENTS

The following further describes an embodiment of the present invention in detail with reference to the accompanying drawings.

Figure 1:
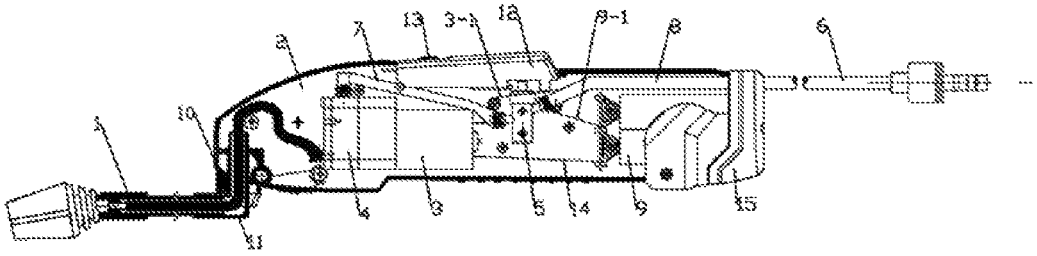
FIG. 1 is a schematic structural diagram of a hand-held battery operated sprayer with a rotatable spray lance according to the present invention.

As shown in FIG. 1, a hand-held battery operated sprayer with a rotatable spray lance includes a spray lance assembly 1 and a spray chamber 2, a motor 3, a pump 4, a shutoff valve 5, a suction hose assembly 6, a pump inlet hose 8, a pump outlet hose 7, a battery pack 9, and a conductor are disposed in the spray chamber 2, water sequentially passes the suction hose assembly 6, the shutoff valve 5, the pump inlet hose 8, the pump 4, and the pump outlet hose 7, and flows out of the spray chamber 2, a rotary axle base 10 is disposed at a front end of the spray chamber 2, a right-angled rotating shaft 11 is movably connected in the rotary axle base 10, the rotating shaft 11 is connected to the spray lance assembly 1, and the pump outlet hose 7 can reach a nozzle of the spray lance assembly 1 through the rotating shaft 11.

Figure 2:
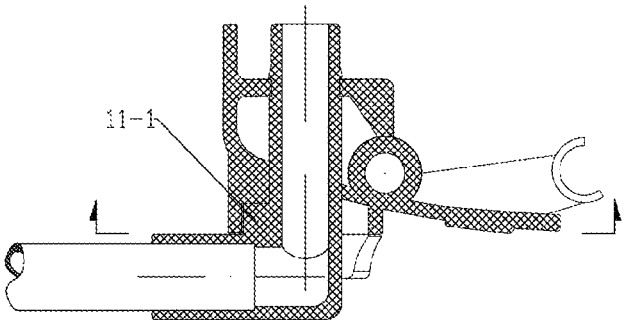
FIG. 2 is a schematic diagram of a rotary part of a hand-held battery operated sprayer with a rotatable spray lance according to the present invention.
Figure 3:
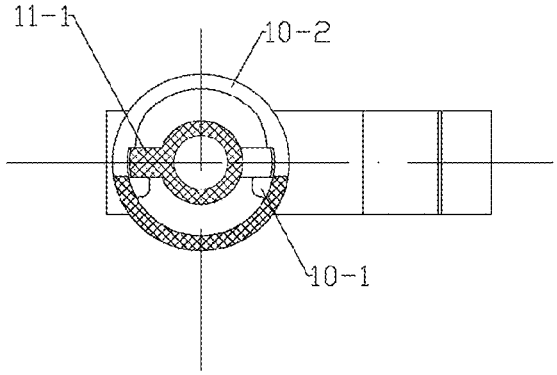
FIG. 3 is a schematic cross-sectional view of a rotary part of a hand-held battery operated sprayer with a rotatable spray lance according to the present invention.

As shown in FIG. 2 and FIG. 3, a limiting block 11-1 is disposed at an inner corner of the rotating shaft 11, two positioning blocks 10-1 are disposed in the rotary axle base 10 in parallel, the rotating shaft 11 rotates in the rotary axle base 10 within a range of 180° under a limiting action of the limiting block 11-1 and the positioning blocks 10-1, and a ring locking block 10-2 is disposed outside the limiting block 11-1.

Figure 4:
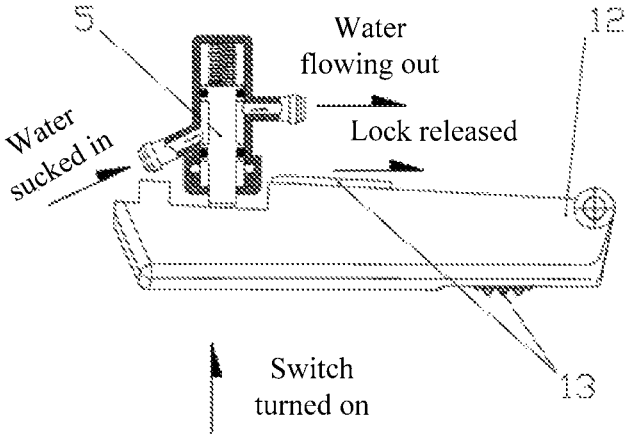
FIG. 4 is a schematic diagram of a hand-held battery operated sprayer with a rotatable spray lance when a switch is turned on according to the present invention.
Figure 5:
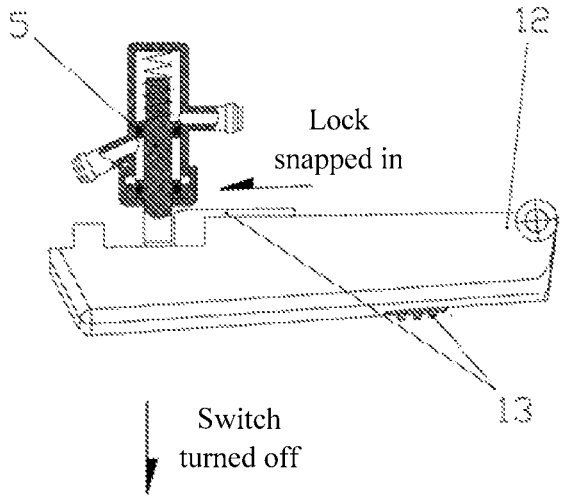
FIG. 5 is a schematic diagram of a hand-held battery operated sprayer with a rotatable spray lance when a switch is turned off according to the present invention.

As shown in FIG. 4 and FIG. 5, a casing of the spray chamber 2 is composed of two protective covers, a push switch 12 is disposed at a junction line of the two protective covers, the push switch 12 is connected to the shutoff valve 5 in the spray chamber 2, pressing drives the shutoff valve 5 to turn on, and the pressing between the push switch 12 and the shutoff valve 5 is locked through a switch lock 13. When a pressing operation is performed on the push switch 12, a motor triggering conductor 3-1 and a battery contact conductor 9-1 are triggered, and a battery-motor connection conductor 14 is further disposed between the motor 3 and the battery pack 9. A battery cover 15 is further disposed on the casing of the spray chamber 2, and is used for manually installing or removing the battery pack 9.

Figure 6:
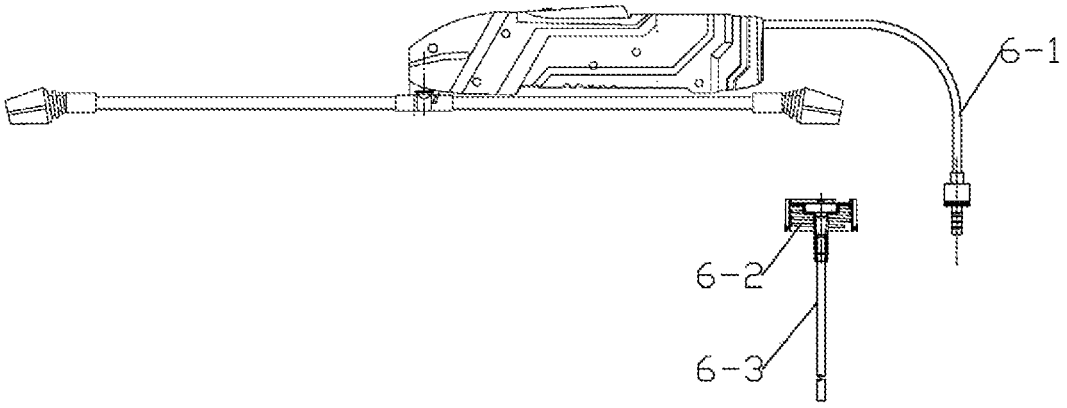
FIG. 6 is a schematic diagram of a suction part of a hand-held battery operated sprayer with a rotatable spray lance according to the present invention.

As shown in FIG. 6, the suction hose assembly 6 includes a suction hose 6-1 and an external suction apparatus, the external suction apparatus includes a bottle cap 6-2 and a suction pipe 6-3 that are of an integrated structure, a plug is disposed at an end of the suction hose 6-1, and the plug at the end of the suction hose 6-1 is inserted in an opening on the bottle cap 6-2 and is connected to the suction pipe 6-3. After the suction hose 6-1 is assembled with the external suction apparatus, the suction pipe 6-3 of the external suction apparatus can be inserted in a liquid in a container for suction.

An operation process of the hand-held battery operated sprayer with a rotatable spray lance in the present invention is as follows:

1. Manually open the battery cover 15 on the casing of the spray chamber 2, install the battery pack 9, and close the battery cover 15. Insert the plug at the end of the suction hose 6-1 in the opening on the bottle cap 6-2, and connect it to the suction pipe 6-3. Insert the suction pipe 6-3 in the liquid in the container to prepare for suction. Rotate the spray lance assembly 1 to drive the rotating shaft 11 to rotate to an operating state, so that the limiting block 11-1 on the rotating shaft 11 reaches the positioning blocks 10-1 on the rotary axle base 10, and snaps into the locking block 10-2 and gets fastened.

2. Hold the casing of the spray chamber 2, point the nozzle at a spraying area, unlock the switch lock 13, and press the push switch 12, so that the push switch 12 pushes down a valve plug of the shutoff valve 5 to make the shutoff valve 5 turn on. In addition, the push switch 12 gets in contact with the motor triggering conductor 3-1 and drives it to get in contact with the battery contact conductor 9-1, so that the motor 3 starts, and the liquid passes the suction hose assembly 6, the shutoff valve 5, the pump inlet hose 8, the pump 4, and the pump outlet hose 7 until it sprays out of the nozzle on the spray lance assembly 1.

3. After spraying is completed, release the push switch 12, so that the valve plug of the shutoff valve 5 is raised to turn off the shutoff valve 5. In addition, the motor triggering conductor 3-1 and the battery contact conductor 9-1 are disconnected, so that the motor 3 stops due to a power outage. Manually rotate the spray lance assembly 1 to drive the rotating shaft 11 to rotate to a storage state, so that the limiting block 11-1 on the rotating shaft 11 reaches the positioning blocks 10-1 on the rotary axle base 10, and snaps into the locking block 10-2 and gets fastened. Lock the switch lock 13 to prevent the push switch 12 from being pressed by mistake, thereby preventing power-on of the motor 3.

The foregoing descriptions are merely preferred implementations of the present invention. It should be noted that, improvements and modifications may be further made by a person of ordinary skill in the art without departing from the principles of the present invention, and these improvements and modifications shall also be construed as falling within the protection scope of the present invention.

What is claimed is:

1. A hand-held battery operated sprayer with a rotatable spray lance, comprising a spray lance assembly and a spray chamber, wherein a motor, a pump, a shutoff valve, a suction hose assembly, a pump inlet hose, a pump outlet hose, a battery pack, and a conductor are disposed in the spray chamber, water sequentially passes the suction hose assembly, the shutoff valve, the pump inlet hose, the pump, and the pump outlet hose, and flows out of the spray chamber, a rotary axle base is disposed at a front end of the spray chamber, a right-angled rotating shaft is movably connected in the rotary axle base, the rotating shaft is connected to the spray lance assembly, and the pump outlet hose is connected with a nozzle of the spray lance assembly through the right-angled rotating shaft;

wherein a limiting block is disposed at an inner corner of the rotating shaft, two positioning blocks are disposed in the rotary axle base in parallel, the rotating shaft rotates in the rotary axle base within a range under a limiting action of the limiting block and the positioning blocks.

2. The hand-held battery operated sprayer with a rotatable spray lance according to claim 1, wherein the range under the limiting action of the limiting block and the positioning blocks is 180°, and a ring locking block is disposed outside the limiting block.

3. The hand-held battery operated sprayer with a rotatable spray lance according to claim 1, wherein a push switch is disposed in the spray chamber, the push switch is connected to the shutoff valve in the spray chamber, pressing drives the shutoff valve to turn on, and the pressing between the push switch and the shutoff valve is locked through a switch lock.

4. The hand-held battery operated sprayer with a rotatable spray lance according to claim 3, wherein when a pressing operation is performed on the push switch, a motor triggering conductor and a battery contact conductor are triggered, and a battery-motor connection conductor is further disposed between the motor and the battery pack.

5. The hand-held battery operated sprayer with a rotatable spray lance according to claim 1, wherein the suction hose assembly comprises a suction hose and an external suction apparatus, the external suction apparatus comprises a bottle cap and a suction pipe that are of an integrated structure, and a plug at an end of the suction hose is inserted in an opening on the bottle cap and is connected to the suction pipe.

6. The hand-held battery operated sprayer with a rotatable spray lance according to claim 3, wherein a battery cover is further disposed on the casing of the spray chamber, and is used for manually installing or removing the battery pack.

* * * * *